United States Patent [19]

Lehmacher

[11] 4,368,051

[45] Jan. 11, 1983

[54] METHOD OF AND APPARATUS FOR MAKING HANDLE BAGS BEARING INDICIA

[76] Inventor: Hans Lehmacher, Im Hummerich, 5216 Niederkassel-Mondorf, Fed. Rep. of Germany

[21] Appl. No.: 231,879

[22] Filed: Feb. 5, 1981

[30] Foreign Application Priority Data

Feb. 6, 1980 [DE] Fed. Rep. of Germany ..... 3004244

[51] Int. Cl.[3] ..... B31B 23/02

[52] U.S. Cl. ..... 493/11; 493/29; 493/196; 493/926

[58] Field of Search ..... 493/11, 22, 29, 10, 493/196, 195, 194, 193, 926, 226

[56] References Cited

U.S. PATENT DOCUMENTS

| | | | |
|---|---|---|---|
| 2,214,593 | 9/1940 | Mustin et al. | 493/29 X |
| 4,164,170 | 8/1979 | Nordin | 493/194 |
| 4,174,657 | 11/1979 | Suominen | 493/197 |
| 4,216,705 | 8/1980 | Achelpohl et al. | 493/11 |

FOREIGN PATENT DOCUMENTS

| | | | |
|---|---|---|---|
| 2608734 | 8/1977 | Fed. Rep. of Germany | 493/193 |

*Primary Examiner*—James F. Coan
*Attorney, Agent, or Firm*—Karl F. Ross

[57] ABSTRACT

Handle bags are made from an elongated synthetic-resin tube having two longitudinal rows of indicia spaced apart in each row by a bag width and with the indicia of one row staggered equidistant between the indicia of the other row. The tube is passed step-wise over a cutting drum formed with an endless circumferentially extending and undulating cutting groove in which a blade engaged inwardly so that an undulating cut is formed longitudinally along the tube separating it into two tube halves which are then passed through a closeable transverse welder. One of the halves is deflected between the drum and the welder through detours dimensioned to put the flaps of the two bag halves in exact transverse alignment with one another. Each transport step is ended when the center of the indicia immediately upstream of the welder is spaced from the welder by a distance equal to half of the bag width and at this time the welder is closed on the tube to form bag-edge seams. The drum is also operated in rotary steps, but each rotary step is stopped after one full revolution of the drum about the drum axis. The rotation rate of the drum is set so that one back-and-forth motion of the blade is effected by the groove in the cutting drum each time the tube is advanced over it by a distance equal to one bag width.

8 Claims, 6 Drawing Figures

METHOD OF AND APPARATUS FOR MAKING HANDLE BAGS BEARING INDICIA

FIELD OF THE INVENTION

The present invention relates to a method of and an apparatus for making handle bags. More particularly this invention concerns the mass-production of shopping bags bearing indicia, normally advertising.

BACKGROUND OF THE INVENTION

In my copending and jointly filed patent application Ser. No. 231,878 I describe a system for making handle shopping bags wherein a synthetic-resin tube is fed through a cutting station at a predetermined feed speed. A cutter is engaged through the tube at the station so as to subdivide the tube into a pair of tube halves. This cutter is reciprocated back and forth transversely of the tube in the station at such a rate as to form on the transversely confronting cut edges of the halves interfitting and staggered handle flaps. One of the tube halves may then be detoured through a distance equal to an ood-whole-number multiple of half of the bag width and then is realigned with the other tube half with the flaps in transverse alignment. The tube halves are then simultaneously seamed together.

More particularly according to my earlier invention the cutter is a blade and the cutting station has a cutting drum formed with an endless circumferentially extending and undulating cutting groove in which the blade engages radially inwardly. Another undulating guide group parallel to the cutting groove but axially offset therefrom is engaged by a cam follower connected to the blade so that the blade exactly tracks the cutting groove. The drum is rotated at a peripheral speed which normally varies from the feed speed so that the tube slips on the drum. If the peripheral speed of the drum is identical to the feed speed the bag width will be exactly equal to the circumference of the drum. If the peripheral speed is greater the bag width will be shorter than the circumference of the drum, and if the peripheral speed is slower the bag width will be greater than the circumference of the drum. Thus merely by changing the rotation rate for the drum it is possible to vary the bag width.

Thus with the system according to the instant invention merely changing the relationship between the feed speed of the tube and the peripheral speed of the drum allows the bag width to be varied. This allows a single apparatus to produce bags of different widths. Under the prior-art systems switching from one bag width to another was a complicated procedure entailing replacement of expensive die parts. With the system of my earlier invention it is merely necessary to vary the relationship between speeds by either changing an element in the transmission for the feed rollers or the cutting drum, or by simply adjusting a variable-ratio transmission.

When bags bearing indicia are to be produced it becomes absolutely essential, however, that the indicia lie in the center of the sides of the bag. Any minor lack of synchronization will rapidly become important in a mass-production system. For instance if each bag is a mere hundredth of an inch off the perfect spacing after a standard run of a thousand bags the indicia will be displaced ten full inches so that the bags will normally be completely useless. It is therefore necessary to provide an operator to monitor the machine for a substantial time during a production run in order to insure that the indicia remain centered. Even so an error of as little as one thousandth of an inch will quickly ruin a run of bags.

OBJECTS OF THE INVENTION

It is therefore an object of the present invention to adapt the system of my earlier invention so that it can make handle bags bearing indicia without difficulty.

Another object is to make such a system which makes handle indicia-bearing bags at high speed with perfect centering of the indicia on the faces of the bags.

SUMMARY OF THE INVENTION

These objects are attained according to the instant invention in a system using the apparatus of the type mentioned above which has a cutting drum, a blade engaging radially inwardly in the undulating groove of the drum, and a closable transverse welder. According to the instant invention the tube is advanced in separate transport steps at a feed speed over the drum at the blade and then through the welder, the tube being advanced at this feed speed during the transport steps and being stationary between them. The drum is rotated in separate rotary steps at a peripheral speed different from the feed speed, the drum being stationary between successive rotary steps. The rotary steps of the drum start generally simultaneously with the transport steps of the feed so that the tube is subdivided transversely by the blade into a pair of tube halves having at the drum staggered and interfitting handle flaps spaced longitudinally apart by the bag width. The rotary steps of the drum are stopped each time after one full revolution of the drum about the drum axis. One of the tube halves is deflected between the drum and the welder through a detour equal to an odd-whole-number multiple of half of the bag width so the flaps of the halves are in exact transverse alignment downstream of the detour and at the welder. Each of the transport steps is ended when the center of the indicia immediately upstream of the welder is spaced from the welder by a distance equal to half of the bag width and generally simultaneously the welder is closed on the tube to form bag-edge seams thereof. The closed welder is opened after formation of the seams and generally simultaneously the next feed step and the next rotary step are started.

Thus with the instant invention there is an automatic correction with each welding operation so that the indicia remain perfectly centered on the bags. If the synchronization between the feed speed for the tube and the peripheral speed of the drum is not quite perfect, this will merely result in slight shifting of the handle flaps along the top of each bag. Such minor shifting is so small as normally to be imperceptible, but if allowed to be added from one production step to the other would quickly result in displacement of the indicia along the bag face so as to make the bag useless.

More particularly a sensor is provided for generating an output each time the drum is in a predetermined angular position. This output is used to stop the rotary step of the drum. Another sensor is provided which is positioned along one of the tube halves somewhat upstream of the welder at such a spacing from the welder that it generates an output when it senses an indicia whose center lies at a distance equal to an odd-whole-number multiple of the desired bag width. When this output is generated the feed is stopped and the welder is closed, the welder automatically being opened again after a predetermined interval dependent purely on how long it takes the welder to form the two seams flanking a row of perforations that is formed by such a welder. The two tube halves thus welded together can be rolled up and supplied to the user so that bags can be ripped off their ends one at a time.

Thus with the system according to the instant invention when changing from one bag to another it is merely necessary to vary the peripheral speed of the drum, increasing it for a smaller bag size and decreasing it for a larger bag size. In addition the spacing between the indicia sensor and the welder must be varied so that the welder closes axactly equidistant between adjacent indicia. This latter adjustment can most easily be carried out empirically once the machine is loaded, and the former adjustment can be effected either simply by setting a lever of a variable-ratio transmission or by substituting a sprocket or gear in the drive for the drum with another of appropriately different size.

The drives for the drum and for the downstream feed rollers which pinch the tube immediately upstream of the welder are connected to a common continuously driven shaft. This shaft is connected at one end via an electromagnetic or similar type of clutch to the feed rollers, this clutch being operable by a controller connected to the indicia sensor. The other end of the shaft is connected via another openable clutch to the drum and this clutch is also operated via a controller, but from the sensor for drum revolution. The two controllers are interconnected so as to start rotary and transport steps at the same time, but as mentioned above the rotary and feed steps are stopped when the respective outputs have been generated.

SPECIFIC DESCRIPTION

Figure 1:
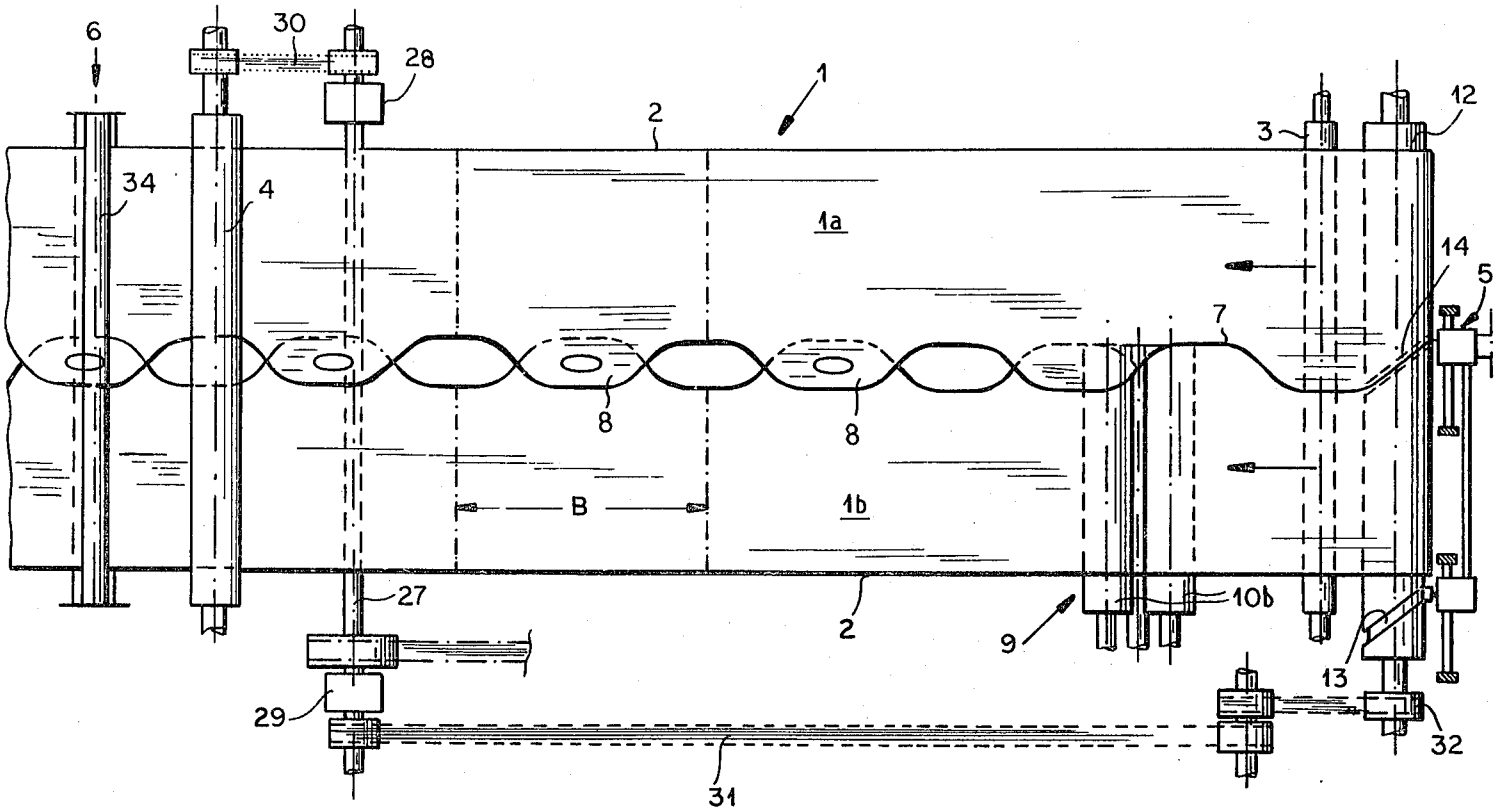
FIG. 1 is a partly schematic top view of the apparatus according to this invention.
Figure 2:
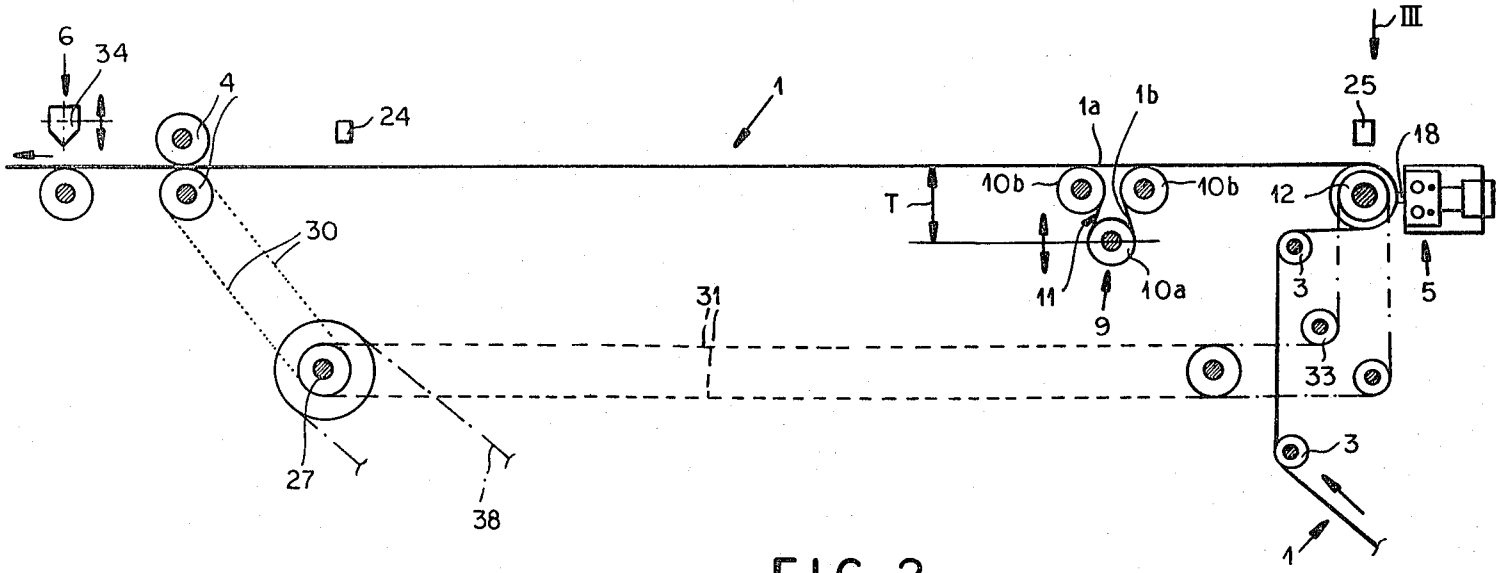
FIG. 2 is a side view of the apparatus of FIG. 1.
Figure 3:
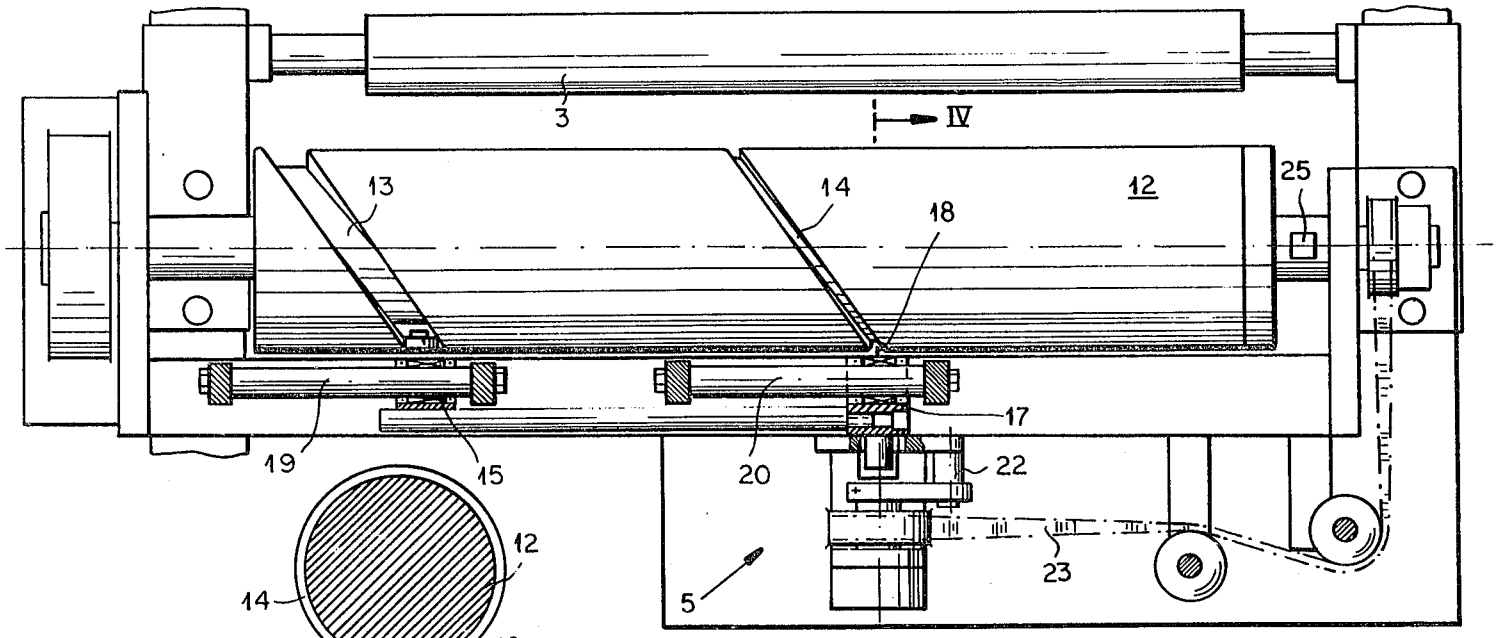
FIG. 3 is a large-scale top view of the detail of FIG. 2 indicated at arrow III.
Figure 4:
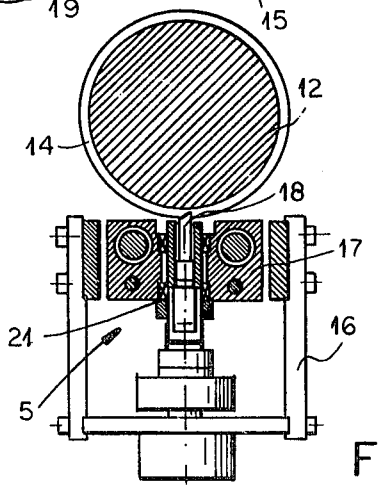
FIG. 4 is a section taken along line IV—IV of FIG. 3.

As seen in FIGS. 1 and 2 a synthetic-resin tube 1 according to the instant invention, which may have its edges folded in to form bags with flaws, has a pair of longitudinal edges 2 and is fed over a succession of upstream feed rollers 3 through a cutting device 5 to a pair of downstream feed pinch rollers 4. A welder 6 has a vertically reciprocal weld bar 34 immediately downstream of the downstream pinch rollers 4.

At the cutting station 5 an undulating cut 7 is formed in the bag 1 to subdivide it into two halves 1*a* and 1*b* having handle flaps 8.

Immediately downstream of the cutting device 5 there is provided a deflecting arrangement 9 comprising a pair of upper rollers 10*b* and a lower roller 10*a* whose center is spaced below the plane of the two halves 1*a* and 1*b* by a distance T. The one tube half 1*b* is deflected over these rollers 10*a* and 10*b* through a detour loop 11 having an overall length equal to an odd-whole-number multiple of half of the bag width B. Thus downstream of deflecting arrangement 9 the flaps 8 will be directly superposed.

As described in somewhat greater detail in my above-cited copending application the cutting device 5 basically comprises a deflecting drum or roller 12 formed adjacent one end with an elliptical guide groove 13 and formed in its center with a cutting groove 14. A follower 15 engages in the groove 13 and is rigidly linked to a blade support 16 having a blade holder 17 with a blade 18 engaged in the groove 14. The follower 15 is carried on fixed axially extending rods 19 and the blade support 17 on similar rods 20 so that the two move axially jointly. The blade 18 is held in a seat 21 in the holder 17 for rotation about an axis perpendicular and radial of the rotation axis of the drum 12. The holder 17 can be pivoted about this axis by means of a crank-type drive 22 operated by means of a belt transmission 23 from the drum 12 so that the blade 18 is always maintained perfectly parallel to the section of the groove 14 in which it is engaging. In this manner the blade 18 will always make an extremely neat cut and the tubes 1*a* and 1*b* will lie flat after being cut.

Figure 5:
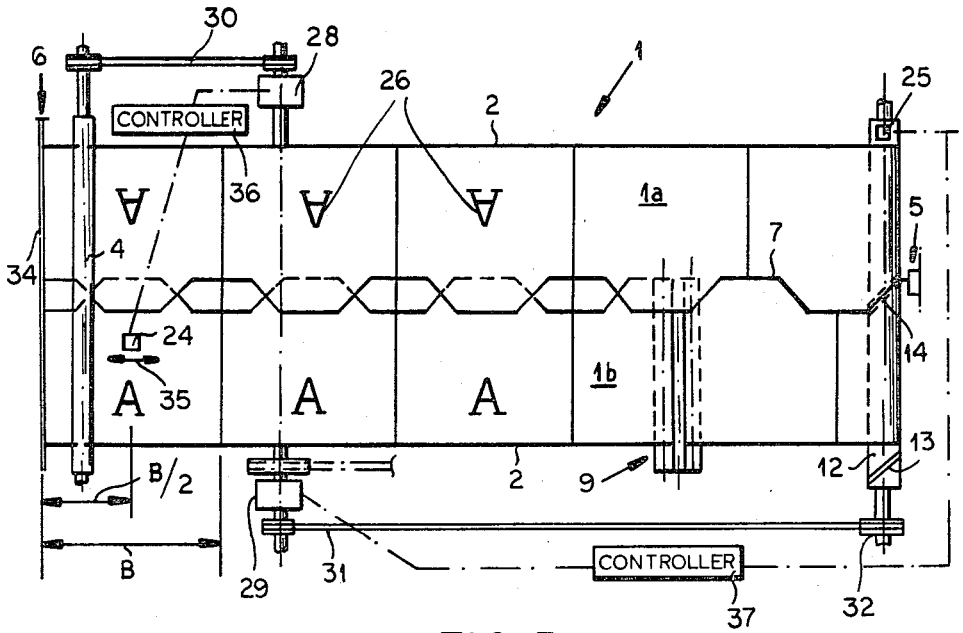
FIGS. 5 and 6 are top views of a portion of the apparatus as shown in FIG. 1 showing how it is set up to make bags of different width.
Figure 6:
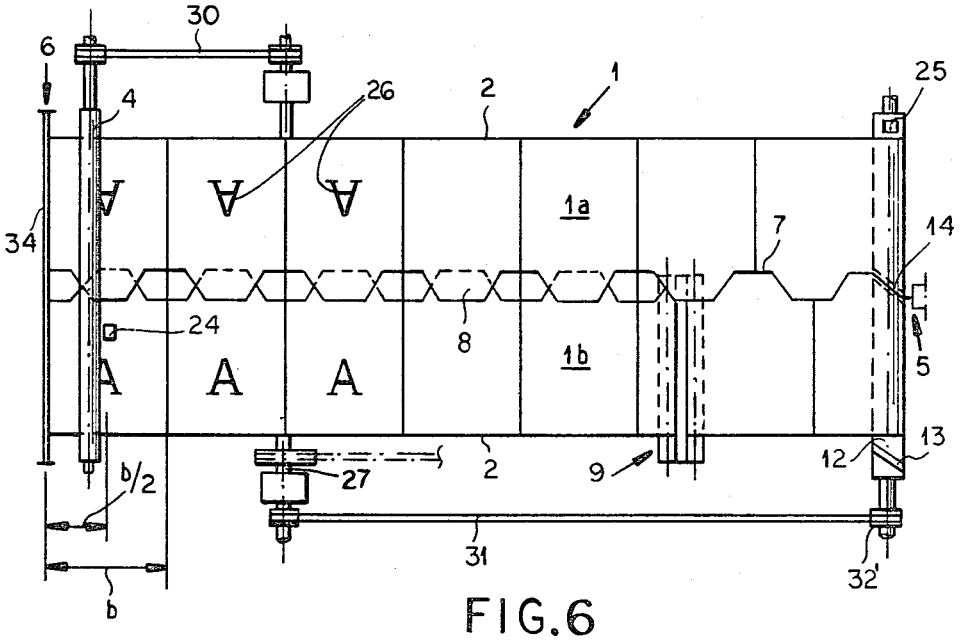

According to this invention and as also shown in FIGS. 5 and 6 a detector 24 is mounted above the tube half 1*b* slightly upstream of the downstream feed rollers 4 and of the welder 6. This detector 24 is displaceable as indicated by arrow 35 parallel to the transport direction of the tube 1. It generates a pulse each time it detects an indicia such as is shown at 26 on the tube half 1*b*. Another detector 25 is provided adjacent the drum 12, and set up to coact with a magnet in this drum 12 so as to generate a pulse each time the drum 12 moves into a predetermined angular position. These detectors 24 and 25 are connected to respective controllers 36 and 37 which are interconnected and connected to respective clutches 28 and 29 carried on the outer ends of a shaft 27 connected via a chain drive 30 to the feed rollers 4 and via a further chain drive 31 to a sprocket 32 at the end of the drum 12. The sprocket 32 can be changed to vary the rotation speed of the drum 12 relative to that of the feed rollers 4, with a tensioning roller 33 being provided to take up any slack.

The drive shaft 27 is continuously rotated by a nonillustrated motor via a chain 38. The clutches 28 and 29 are of the fast-acting electromagnetic type.

As shown in FIG. 5 the system according to the instant invention is set up to produce bags of the width B. To this end indicia detector 24 is set at a distance B/2 from the weld bar 34. The machine is initially set up so that when the detector 24 generates a pulse indicating that the indicia 26 has its center spaced by this distance B/2 from the welder 34 the magnet in the drum 12 will be underneath the feed switch consituting the detector 25. Both of the detectors 24 and 25 will therefore generate signals which will open both of the respective clutches 28 and 29 to stop feeding of the tube halves 1*a* and 1*b* and rotation of the drum 12. The controllers 36 and 37 then automatically close the weld bar 35 on the two tube halves 1*a* and 1*b* so as to form a pair of transverse seams flanking a row of perforations.

After the welding operation is completed the weld bar 34 is raised and the controllers 36 and 37 automatically close both of the clutches 28 and 29 so as to advance the tube 1 downstream while forming the cut 7 in it. As soon as the next indicia 26 comes underneath the detector 24 this detector 24 opens the clutch 28 to stop the feed means of the feed rollers 4. At approximately the same time the detector 25 will detect the predetermined angular position of the drum 12 and will open the clutch 29 to stop rotation of the drum 12 also. The next pair of bags is welded and the cycle repeats itself.

FIG. 6 shows how the system can be operated using a smaller bag width b so that the detector 24 is moved a spacing b/2 from the weld bar 34. At the same time the gear 32 is replaced with a gear 32' that will rotate the drum 12 somewhat faster so that handle flaps 8 will be formed at centers spaced apart by the distance b. The synchronization of the peripheral speed of the drum 12 and of the feed speed of the tube 1 is carried out in accordance with the principles described in my above-cited copending application. The two ratios are set so that one revolution of the drum 12 takes place in approximately the time it takes for a single bag width to pass a given point on the path.

Nonetheless with the system according to the instant invention small discrepancies in the setting-up of the machine will not result in bags being produced with the indicia 26 offcenter. Instead as each bag is welded a self-correcting action is carried out to insure that each handle 8 is in the center of the respective bag when it is produced. In the prior-art systems a deviation of as little as one-thousandth of an inch would result in a standard run of five thousand bags of a misplacement of the indicia by five full inches, rendering most bags completely useless. With the instant invention, however, a discrepancy of as great as one-half inch, which is 500 times as great as the normally intolerable interval, would only result in the handles 8 being shifted on each bag one-half inch to one side, a shift that would hardly even be noticeable. Thus the system according to the instant invention makes setting-up of the apparatus relatively simple and allows the apparatus to run without close supervision. What is more the necessity of providing a great many different sprockets 32 for incremental changes in bag sizes becomes unnecessary. In fact the changing of sprocket 32 could be eliminated altogether in accordance with the instant invention by replacement with a simple variable-speed of transmission whose losses would make it normally unusable in most such systems.

I claim:

1. A method of making handle bags from an elongated synthetic-resin tube having two longitudinal rows of indicia spaced apart in each row by a bag width and with the indicia of one of said rows staggered equidistant between the indicia of the other row, said method employing an apparatus having:

a cutting drum formed with an endless circumferentially extending and undulating cutting groove, centered on and rotatable about a drum axis, and having a circumference different from said bag width;

a blade engaging radially inwardly in said groove; and a closable transverse welder; said method comprising the steps of:

advancing said tube in separate transport steps at a feed speed over said drum at said blade and then through said welder;

rotating said drum in separate rotary steps at a peripheral speed different from said feed speed and with the rotary steps starting generally simultaneously with said transport steps, said feed and peripheral speeds being such that said tube is subdivided transversely by said blade into a pair of tube halves having at said drum staggered and interfitting handle flaps spaced longitudinally apart by said bag width;

stopping said rotary steps each time after one full revolution of said drum about said drum axis;

deflecting one of said halves between said drum and said welder through a detour equal to an odd-whole-number multiple of half of said bag width so said flaps of said halves are in exact transverse alignment downstream of said detour;

ending each transport step when the center of the indicia immediately upstream of said welder is spaced from said welder by a distance equal to half of said bag width and generally simultaneously closing said welder on said tube to form bag-edge seams thereon; and opening the closed welder after formation of said seams and generally simultaneously starting the next feed step and the next rotary step.

2. The method defined in claim 1 wherein said drum is rotated at such peripheral speed relative to said feed speed that one revolution of said drum generally corresponds to an advance of said tube at said feed speed through one bag width.

3. An apparatus for making handle bags from an elongated synthetic-resin tube having two longitudinal rows of indicia spaced apart in each row by a bag width and with the indicia of one row staggered equidistant between the indicia of the other row, said apparatus comprising:

a cutting drum formed with an endless circumferentially extending and undulating cutting groove, centered on and rotatable about a drum axis, and having circumference different from said bag width;

a blade engaging radially inwardly in said groove;

guide means supporting said blade in said groove for moving said blade axially of said drum as same rotates to keep said blade in said groove;

drum sensor means for generating a drum output each time said drum is in a predetermined angular position;

drum drive means connected to said drum and to said sensor means for rotating said drum step-wise at a predetermined peripheral speed and for arresting rotation of said drum each time said drum sensor means generates said drum output;

feed means including a dowstream feed roller and an upstream feed roller engaging said tube for advancing same in feed steps from said upstream roller to said downstream roller over said drum at a predetermined feed speed normally different from said peripheral speed, whereby said tube is subdivided transversely by said blade on passing over said drum while said drum is rotating into a pair of tube halves having at said drum staggered and interfitting handle flaps;

deflecting guides between said drum and said downstream feed roller engaging only one of said halves and detouring same through a detour equal to an odd-whole-number multiple of half of said bag width, whereby said flaps of said halves are in exact transverse juxtaposition downstream of said detour;

welding means closable on said tube halves downstream of said detour for transversely seaming together each of said tubes at bag-edge seams;

indicia sensor means upstream along said tube halves of said welding means for generating an indicia output each time one of said indicia is on a center spaced upstream of said welding means by half of said bag width; and control means connected to said indicia sensor means and to said feed means for stopping feeding of said tube each time said indicia output is generated and simultaneously closing said welding means and connected to said drum drive means for starting rotation of said drum and for starting feeding of said tube after formation of said seams and opening of said welding means.

4. The apparatus defined in claim 3, further comprising a continuously rotating main drive shaft, said drum drive means including an openable clutch connected between said shaft and said drum and said control means including an openable clutch connected between said shaft and said downstream roller.

5. The apparatus defined in claim 3 wherein said drum is formed with an endless circumferentially extending and undulating guide groove axially offset from and parallel to said cutting groove, said guide means including a cam follower engaged in said guide groove and structure axially rigidly connecting said cam follower and said blade for joint axial displacement.

6. The apparatus defined in claim 3 wherein said blade is generally planar, said apparatus further comprising means for rotating said blade about an axis generally radial of said drum axis for holding said blade parallel to the section of said cutting groove in which it is engaged.

7. The apparatus defined in claim 3 wherein said deflecting guides are three guide rollers one of which is displaceable toward and away from the other two.

8. The apparatus defined in claim 3 wherein said indicia sensor means includes a detector displaceable parallel to said tube upstream of said welder.

* * * * *